US005189238A

United States Patent [19]

Hayakawa

[11] Patent Number: 5,189,238

[45] Date of Patent: Feb. 23, 1993

[54] AUTOMATIC PERFORMANCE APPARATUS FOR CAUSING DIFFERENT KINDS OF SOUND SOURCES TO SYNCHRONOUSLY GENERATE TONES

[75] Inventor: Tokuji Hayakawa, Hamamatsu, Japan

[73] Assignee: Yamaha Corporation, Hamamatsu, Japan

[21] Appl. No.: 593,241

[22] Filed: Oct. 5, 1990

[30] Foreign Application Priority Data

Oct. 11, 1989 [JP] Japan ..... 1-264742

[51] Int. Cl.[5] ..... G10H 1/18; G10H 7/00

[52] U.S. Cl. ..... 84/609; 84/615; 84/649; 84/653

[58] Field of Search ..... 84/609-620, 84/630, 631, 634-638, 649-658, 662, 664, 666-669, 671, 678-690, 707, 708, 712-717, DIG. 4, DIG. 12, DIG. 22, DIG. 23, DIG. 29

[56] References Cited

U.S. PATENT DOCUMENTS 4,022,097 5/1977 Stangio ..... 84/DIG. 12

4,744,281 5/1988 Isozaki ..... 84/DIG. 4

4,932,304 6/1990 Franzmann ..... 84/671

*Primary Examiner*—Stanley J. Witkowski

*Attorney, Agent, or Firm*—Spensley Horn Jubas & Lubitz

[57] ABSTRACT

An automatic performance apparatus output key data to different kinds of first and second internal or external sound sources and causes the first and second sound sources to synchronously generate tones. Key data is outputted to the first sound source after the lapse of a first delay time data is outputtted to the second sound source after the lapse of a second delay time. When the first sound source, which immediately starts tone generation in response to a tone generation instruction, and the second sound source, which starts tone generation with a delay time from the tone generation instruction, are caused to perform tone generation, a tone generation instruction to the first sound source is delayed from that to the second sound source, thus allowing synchronous musical tone generation between the two sound sources.

19 Claims, 12 Drawing Sheets

| DELAY MODE (DLYMD) | DLYTM | INTERNAL SOUND SOURCE | EXTERNAL SOUND SOURCE | SETUP DELAY AMOUNT |
|---|---|---|---|---|
| COMMON MODE CMN (0) | 0 | IMMEDIATE DRIVING | IMMEDIATE DRIVING | TI = TO = 0 |
| | OTHER THAN 0 | DELAYED DRIVING | DELAYED DRIVING | TI = TO ≠ 0 |
| MINUS MODE − (1) | 0 | IMMEDIATE DRIVING | IMMEDIATE DRIVING | TI = TO = 0 |
| | OTHER THAN 0 | DELAYED DRIVING | IMMEDIATE DRIVING | TI ≠ 0, TO = 0 |
| PLUS MODE + (2) | 0 | IMMEDIATE DRIVING | IMMEDIATE DRIVING | TI = TO = 0 |
| | OTHER THAN 0 | IMMEDIATE DRIVING | DELAYED DRIVING | TI = 0, TO ≠ 0 |

FIG. 3

AUTOMATIC PERFORMANCE APPARATUS FOR CAUSING DIFFERENT KINDS OF SOUND SOURCES TO SYNCHRONOUSLY GENERATE TONES

BACKGROUND OF THE INVENTION

1. Field of the Invention

The present invention relates to an automatic performance apparatus using a plurality of sound sources and, more particularly, to a technique for controlling the sound sources to have synchronous tone generation start timings.

2. Prior Art

Conventionally, an automatic performance apparatus for driving a mechanical sound source, e.g., a pipe organ, a piano, or the like on the basis of key data (e.g., a key code and a tone generation timing) read out from, e.g., a memory, is known.

Another automatic performance apparatus for driving an electronic sound source of a waveform readout type or waveform synthesis type on the basis of key data read out from, e.g., a memory is also known.

Of the two kinds of sound sources described above, an electronic sound source starts generation of a musical tone immediately in response to a tone generation instruction. A mechanical sound source, e.g., a piano performs a mechanical operation, e.g., drives a hammer in accordance with a tone generation instruction. For this reason, the mechanical sound source starts tone generation with a delay time from the tone generation instruction.

When an automatic performance is performed using both the two kinds of sound sources, a tone generation start timing of the mechanical sound source is delayed from that of the electronic sound source in response to an identical tone generation instruction. For this reason, a good session effect cannot be obtained.

SUMMARY OF THE INVENTION

It is an object of the present invention to provide an automatic performance apparatus which can cause different kinds of sound sources to synchronously generate musical tones.

According to the first aspect of the present invention, an automatic performance apparatus for outputting key data to different kinds of first and second internal or external sound sources and causing them to synchronously generate tones, comprises key data generation means for sequentially generating key data, first delay means for inputting the key data supplied from the key data generation means and outputting the key data to the first sound source after lapse of a first delay time, and second delay means for inputting the key data supplied from the key data generation means and outputting the key data to the second sound source after lapse of a second delay time.

According to the second aspect of the present invention, an automatic performance apparatus for outputting key data to different kinds of first and second internal or external sound sources and causing them to synchronously generate tones, comprises key data generation means for sequentially generating key data, first delay means for inputting the key data supplied from the key data generation means and outputting the key data (first key data) after lapse of a first delay time, second delay means for inputting the key data supplied from the key data generation means and outputting the key data (second key data) after lapse of a second delay time, mode designation means for alternatively designating a first or second mode, and key data output means for, when the first mode is designated by the mode designation means, inputting said first and second key data supplied from the first and second delay means and outputting said first and second key data to the first and second sound sources, respectively, and for, when the second mode is designated by the mode designation means, inputting said first and second key data supplied from the first and second delay means and outputting said first and second key data to the second and first sound sources, respectively.

The key data generation means preferably includes storage means for storing the key data, and readout means for reading out the key data from the storage means.

The key data generation means may includes data input means for inputting the key data from the outside.

The key data generation means preferably has alternative modes, i.e., record and play modes. When the record mode is selected, the key data inputted from the data input means is stored in the storage means. When the play mode is selected, the key data read out from the storage means is supplied to the first and second delay means.

Furthermore, the automatic performance apparatus may comprise means for selecting whether or not the key data inputted from the data input means is supplied to the first and second delay means.

The first and second delay means may receive both the key data inputted from the data input means and the key data read out from the storage means.

The first and second delay means preferably include setting means for respectively setting the first and second delay times.

The automatic performance apparatus described above is connected to a plurality of (at least two kinds of) sound sources. The different kinds of first and second sound sources receive key data outputted from the automatic performance apparatus, and generate tones according to the inputted key data. The first and second sound sources are arranged inside or outside the automatic performance apparatus.

The automatic performance apparatus may comprise means for selecting whether or not key data outputted from each delay means is inputted to the first and second sound sources.

The automatic performance apparatus according to the first aspect of the present invention outputs key data to the first sound source (e.g., an electronic sound source), and the second sound source (e.g., a mechanical sound source). For example, the first sound source which is the electronic sound source receives the key data outputted from the first delay means, and the second sound source which is the mechanical sound source receives the key data outputted from the second delay means. The electronic sound source immediately generates a tone in response to the inputted key data. The mechanical sound source generates a tone after a delay time ($T\alpha$) caused by a mechanical operation. Thus, the first delay time (T1) of the first delay means is set to be longer than the second delay time (T2) of the second delay means by the time ($T\alpha$). More specifically, the first and second delay times are set to satisfy $T1-T2=T\alpha$. For example, the second delay means immediately outputs key data ($T2=0$), and the first delay means outputs key data after a delay time ($T1=T\alpha$). Thus, the first and second sound sources can generate tones at the same time. More specifically, the first and second sound sources can synchronously generate musical tones.

When the automatic performance apparatus according to the second aspect of the present invention described above employs an electronic sound source as the first sound source and a mechanical sound source as the second sound source, it causes the mode designation means to set, e.g., the first mode. In the first mode, the key data output means inputs key data (first key data) supplied from the first delay means and outputs the first key data to the first sound source, and inputs key data (second key data) supplied from the second delay means and outputs the second key data to the second sound source.

In contrast to this, when a mechanical sound source is used as the first sound source and an electronic sound source is used as the second sound source, the mode designation means designates the second mode. In the second mode, the key data output means inputs key data (first key data) supplied from the first delay means and outputs the first key data to the second sound source, and inputs key data (second key data) supplied from the second delay means and outputs the second key data to the first sound source.

In either case, when the first delay time (T1) of the first delay means is set to be longer than the second delay time (T2) of the second delay means by the time ($T\alpha$) like above mentioned case, the output from the first delay means is inputted to the electronic sound source, and the output from the second delay means is inputted to the mechanical sound source. Therefore, for example, when it is present that the first delay means immediately outputs key data, and the second delay means outputs key data after a present delay time, a user need not pay special attention to connections between the automatic performance apparatus and the electronic and mechanical sound sources since the connections between the delay means and the sound sources can be easily switched by switching modes.

BRIEF DESCRIPTION OF THE DRAWINGS

FIG. 3 is a table for explaining sound source driving operations in units of delay modes;

DESCRIPTION OF THE PREFERRED EMBODIMENTS

Figure 1:
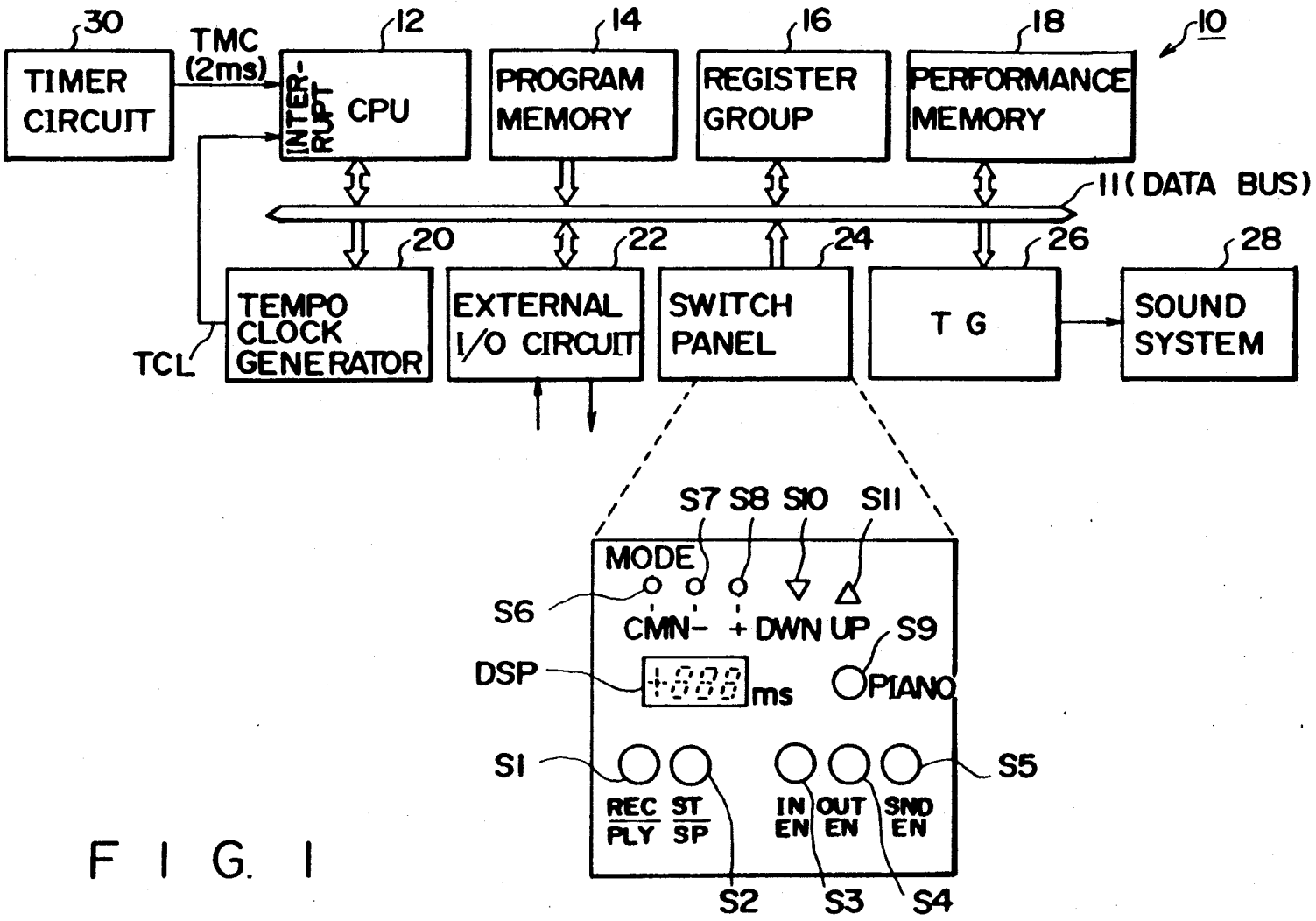
FIG. 1 is a block diagram showing an arrangement of an automatic performance apparatus according to an embodiment of the present invention.

FIG. 1 shows an arrangement of an automatic performance apparatus according to an embodiment of the present invention. In this automatic performance apparatus, a microcomputer controls memory write access of performance data, a delay operation of key data, an automatic performance using a plurality of sound sources, and the like.

1. Arrangement of Automatic Performance Apparatus in FIG. 1

In an automatic performance apparatus 10 shown in FIG. 1, a data bus 11 is connected to a central processing unit (CPU) 12, a program memory 14, a register group 16, a performance memory 18, a tempo clock generator 20, an input/output (I/O) circuit 22, a switch panel 24, a tone generator (TG) 26, and the like.

The CPU 12 executes various processing operations according to a program stored in the memory 14. The processing operations of the CPU 12 will be described in detail below with reference to FIGS. 7 to 11.

The register group 16 includes a large number of registers used in various processing operations by the CPU 12. Registers associated with the embodiment of the present invention will be described later.

The performance memory 18 stores performance data (key data and timing data) for an automatic performance. The data format of the performance memory 18 will be described later with reference to FIG. 4.

The tempo clock generator 20 generates a tempo clock signal TCL according to a given tempo. The signal TCL is supplied to the CPU 12 as an interrupt instruction. Every time the signal TCL is generated, a clock interrupt routine shown in FIG. 9 runs.

The I/O circuit 22 receives key data from a communication line of, e.g., an MIDI (Musical Instrument Digital Interface). The I/O circuit 22 outputs key data to an external sound source such as a piano which can be electrically driven.

The tone generator (TG) 26 is an internal sound source for forming and outputting a musical tone signal according to key data inputted from the I/O circuit 22 or key data read out from the performance memory 18. The automatic performance apparatus incorporates one tone generator 26 (internal sound source). As the tone generator 26, for example, an electronic sound source is used. A musical tone signal from the tone generator 26 is supplied to a sound system 28 including an output amplifier, a loudspeaker, and the like, and is converted into an acoustic wave.

A timer circuit 30 generates a timing signal TMC with, e.g., a 2-msec (milliseconds) cycle. The signal TMC is supplied to the CPU 12 as an interrupt instruction. Every time the signal TMC is generated, a timer interrupt routine shown in FIG. 11 runs.

The switch panel 24 has various control switches, displays, and indicators. The switches, displays, and indicators associated with the embodiment of the present invention will be summarized below:

(1) Record/play (REC/PLY) switch S1 . . . This switch is used to switch a record or play mode. In the record mode, performance data (performance information) is written in the performance memory 18. In the play mode, performance data is read out from the performance memory 18 to execute an automatic performance.

(2) Start/stop (ST/SP) switch S2 . . . This switch is used to instruct start or stop of an operation in the record or play mode.

(3) Input enable (INEN) switch S3 . . . This switch is used to select whether or not input of key data by the I/O circuit 22 is enabled.

(4) Output enable (OUTEN) switch S4 . . . This switch is used to select whether or not output of key data by the I/O circuit 22 is enabled.

(5) Tone generation enable (SNDEN) switch S5 . . . This switch is used to select whether or not supply of key data to the tone generator 26 as the internal sound source is enabled.

(6) Delay mode selection switches S6 to S8 . . . Of these switches, a switch S6 is a common (CMN) mode selection switch, a switch S7 is a minus (−) mode selection switch, and a switch S8 is a plus (+) mode selection switch. The delay mode includes three modes, i.e., a common mode, a minus mode, and a plus mode. In any of these modes, a delay time can be set to fall within a range of 0 to 500 msec. The delay time is defined by a delay value calculated in units of 2 msec. As will be described later, the delay value is set in a register DLYTM. The range of the delay value is 0 to 250.

In the common mode, the CPU 12 delays key data to be outputted to the external sound source by a predetermined period of time, delays key data to be outputted to the internal sound source (tone generator 26) by the same delay time, and outputs the key data to these sound sources. In the minus mode, the CPU 12 outputs key data to be outputted to the internal sound source with a delay time from that to the external sound source. In the plus mode, the CPU 12 outputs key data to be outputted to the external sound source with a delay time from that to the internal sound source.

(7) Piano mode selection switch S9 . . . This switch is mainly used when an electrically driven piano is used as the external sound source. This switch can select a piano mode. In the piano mode, key data to be outputted to the internal sound source is delayed by a predetermined amount (in this embodiment, 20 msec) from that to the external sound source. The piano mode is equivalent to the minus mode with a delay time of 20 msec (delay value=10) selected by the switch S7. The piano mode can be regarded as one kind of the minus mode.

(8) Delay time display DSP . . . This display displays a setup delay time. Furthermore, when the minus or piano mode is selected, the display DSP displays a minus sign. In the common or plus mode, the display DSP displays a plus sign. After either sign, a delay time is displayed in units of milliseconds. When the power switch is turned on, the display DSP displays "0" (immediate output) as a delay time.

(9) Down (DWN) switch S10 and Up (UP) switch S11 . . . These switches are used to increase/decrease a delay time displayed on the display DSP. Every time the up switch S10 is depressed, the delayed value is increased in units of 2 msec. Every time the down switch S11 is depressed, the displayed value is decreased in units of 2 msec.

2. Summary of Operation (FIGS. 2 & 3)

Figure 2:
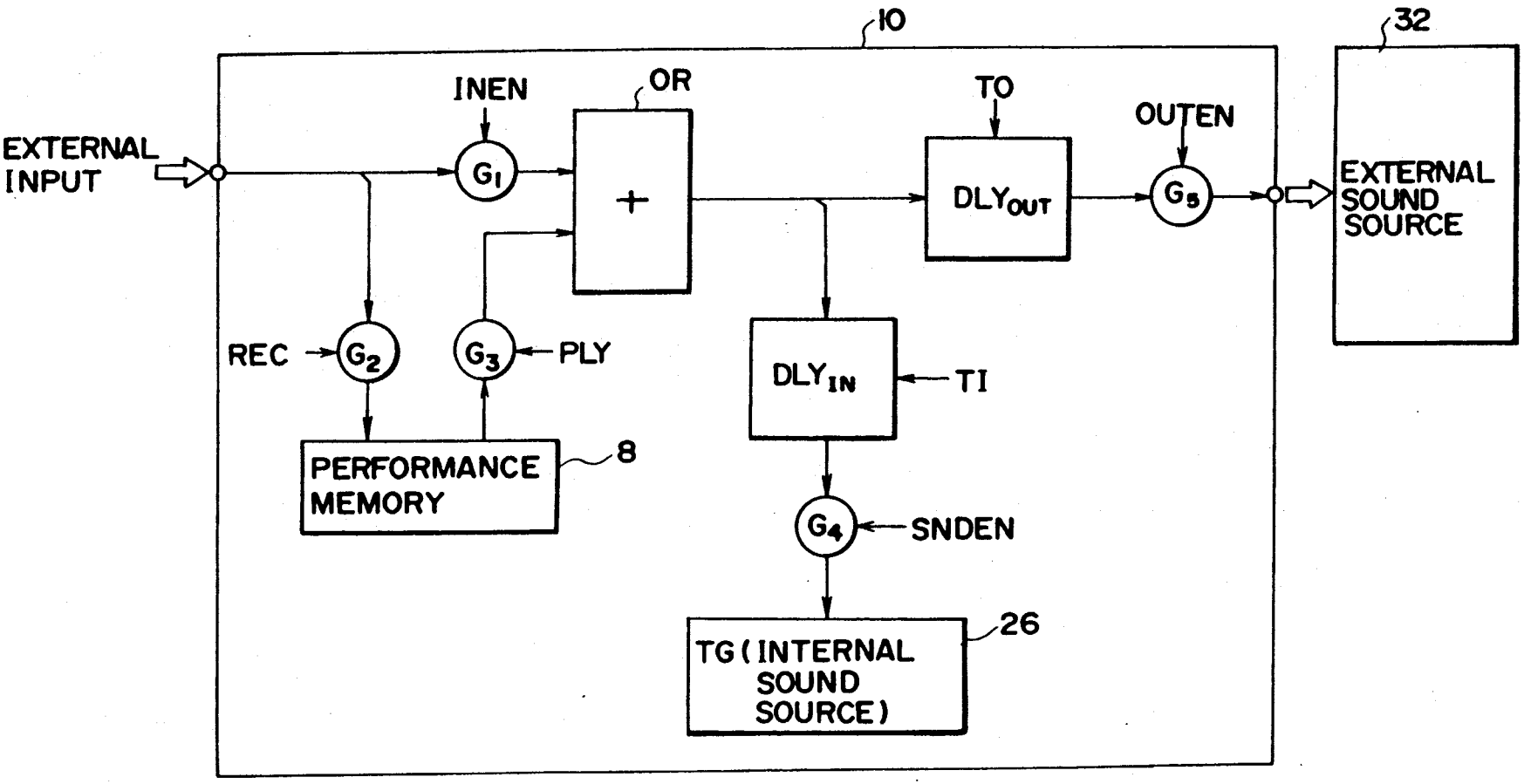
FIG. 2 is a conceptual diagram showing the automatic performance apparatus shown in FIG. 1.

FIG. 2 is a schematic diagram of the automatic performance apparatus 10 described above. The operation of the automatic performance apparatus 10 will be briefly described below with reference to FIG. 2.

When an input enable (INEN) mode is selected by the switch S3, key data inputted from the outside is supplied to an OR gate OR via a gate G1. When the record (REC) mode is selected by the switch S1, key data inputted from the outside is written in the performance memory 18 via a gate G2.

When the play (PLY) mode is selected by the switch S1, key data stored in the performance memory 18 is read out through a gate G3, and is supplied to the OR gate OR.

Key data outputted from the OR gate OR (key data externally inputted through the gate G1 and/or key data read out from the performance memory 18 via the gate G3) is supplied to a delay means $DLY_{IN}$ for the internal sound source and a delay means $DLY_{OUT}$ for the external sound source. Reference symbol TI denotes a setup value of a delay time in the delay means $DLY_{IN}$ for the internal sound source. Reference symbol TO denotes a setup value of a delay time in the delay means $DLY_{OUT}$ for the external sound source.

When tone generation of the internal sound source is enabled (SNDEN) by the switch S5, key data outputted from the delay means $DLY_{IN}$ is supplied to the tone generator (internal sound source) 26 via a gate G4. According to this key data, the tone generator 26 generates a musical tone signal. When output to the external sound source is enabled (OUTEN) by the switch S4, key data outputted from the delay means $DLY_{OUT}$ is supplied to an external sound source 32 via a gate G5. According to this key data, the external sound source 32 generates a musical tone signal.

FIG. 3 shows sound source driving operations in units of delay modes. In FIG. 3, reference symbol DLYMD denotes a delay mode register; and DLYTM, a delay time register. These registers will be described in detail later. Briefly stated, the delay mode register DLYMD stores a value indicating which one of the common, minus, and plus modes corresponds to the present mode. A value "0" indicates the common mode; "1", the minus mode; and "2", the plus mode. The delay time register DLYTM stores a delay value for defining a delay time.

In the common (CMN) mode, the value of the register DLYMD is "0". If the value of the register DLYTM is "0" in the common mode, both the internal and external sound sources are immediately driven without a delay time. This state corresponds to a case wherein TI=TO=0 is set in the circuit shown in FIG. 2. If the value of the register DLYTM is other than "0" in the common mode, the internal and external sound sources are driven with a delay time corresponding to the value of the register DLYTM. This state corresponds to a case wherein TI=TO≠0 in the circuit shown in FIG. 2.

In the minus mode, the value of the register DLYMD is "1". If the value of the register DLYTM is "0" in the minus mode, the internal and external sound sources are immediately driven like in the case wherein TI=TO=0 described above. If the value of the register DLYTM is other than "0" in the minus mode, the internal sound source is driven with a delay time corresponding to the value of the register DLYTM, and the external sound source is immediately driven without a delay time. This state corresponds to a case wherein TI≠0 and TO=0 in the circuit shown in FIG. 2. For example, when an immediate response type electronic sound source is used as the internal sound source and a delayed response type mechanical sound source is used as the external sound source, the above-mentioned delay operation is convenient since musical tones can be synchronously generated.

In the plus mode, the value of the register DLYMD is "2". If the value of the register DLYTM is "0" in the plus mode, the internal and external sound sources are immediately driven like in the case of TI=TO=0 described above. If the value of the register DLYTM is other than "0" in the plus mode, the internal sound source is immediately driven without a delay time, and the external sound source is driven with a delay time corresponding to the value of the register DLYTM. This state corresponds to a case wherein TI=0 and TO≠0 in the circuit shown in FIG. 2. For example, when a delayed response type mechanical sound source is used as the internal sound source and an immediate response type electronic sound source is used as the external sound source, this delay operation is convenient since musical tones can be synchronously generated.

3. Performance Data Format (FIG. 4)

Figure 4:
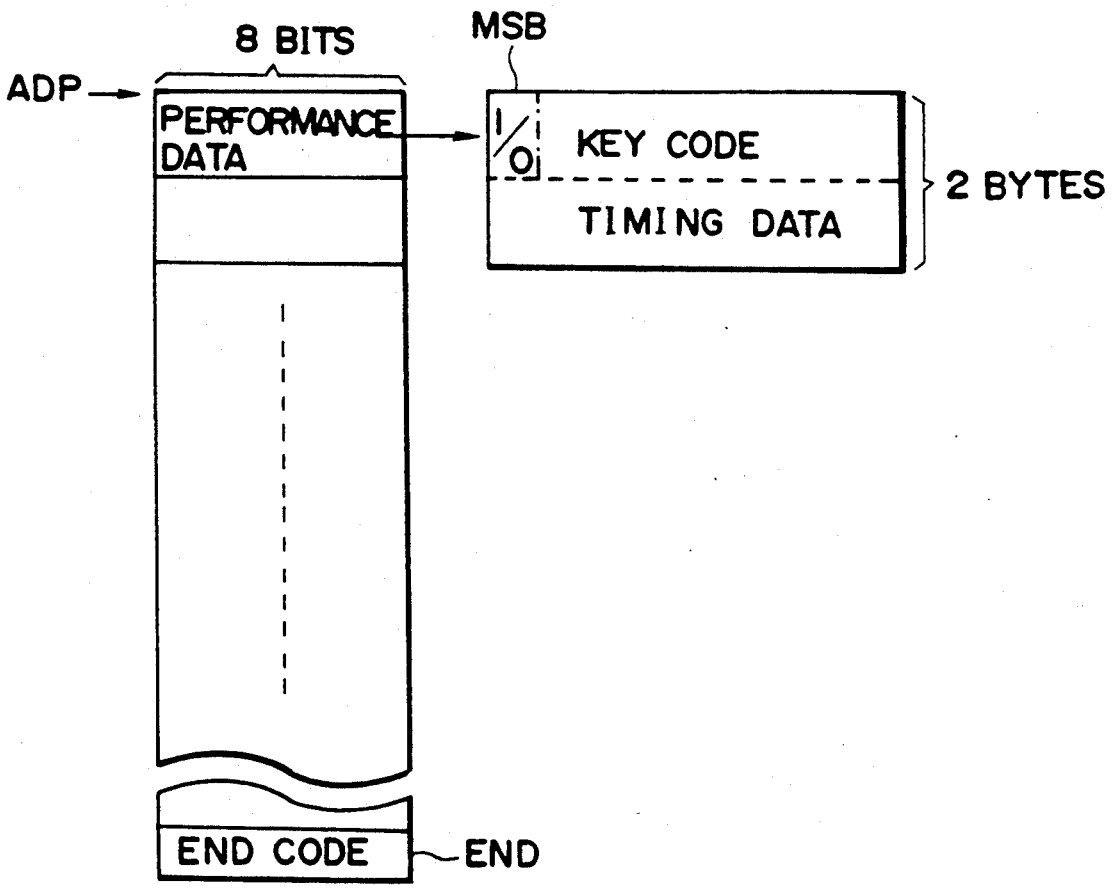
FIG. 4 shows a data format of a performance data memory.

FIG. 4 shows a performance data format in the performance memory 18.

In the performance memory 18, 2-byte performance data are sequentially stored along with addresses, and finally, 1-byte end code data END is stored. Each performance data consists of the first byte of key data, and the second byte of timing data. In each key data, the MSB (most significant bit) is "1" or "0" to indicate a key ON or OFF event, and lower 7 bits represent a key code corresponding to a pitch of a musical tone to be generated or muted. Each timing data is a value ranging from 0 to 31, and represents a timing within one measure. The value ranging from 0 to 31 indicates a timing obtained by dividing one measure into 32 equal time intervals. An address pointer ADP addresses performance data in the performance memory 18.

4. Register Group 16

Of the registers in the register group 16, those associated with the embodiment of the present invention will be summarized below:

(1) Address pointer ADP . . . This pointer serves as a register for storing an address value for pointing a position in the performance memory 18.

Figure 5:
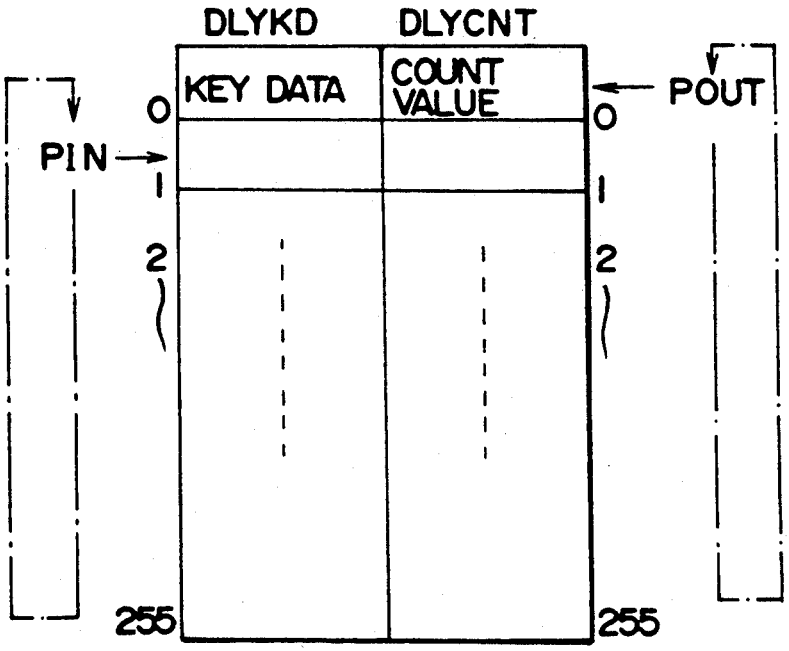
FIG. 5 shows a data format of a ring buffer.

(2) Key data ring buffer DLYKD . . . This buffer serves as a register consisting of 256 elements having addresses 0 to 255, as shown in FIG. 5. Each element stores key data. It should be noted that if a pointer storing an address (within a range of 0 to 255) is represented by PIN, an element pointed by the pointer PIN will be expressed as DLYKD(PIN).

(3) Delay measurement ring buffer DLYCNT . . . This buffer serves as a register consisting of 256 elements having addresses 0 to 255 corresponding to the addresses of the ring buffer DLYKD, as shown in FIG. 5. Each element stores a count value obtained by counting the timing signal TMC from the timer circuit 30. Note that if a pointer storing an address (within a range of 0 to 255) is represented by PIN, an element pointed by the pointer PIN will be expressed as DLYCNT(PIN).

(4) Ring buffer input pointer PIN . . . This pointer points the elements of the ring buffers DLYKD and DLYCNT, as shown in FIG. 5. This pointer PIN points elements to which data is to be written next of those of the ring buffers DLYKD and DLYCNT. The value of the pointer PIN is reset when it reaches "256".

(5) Ring buffer output pointer POUT . . . This pointer points elements of the ring buffers DLYKD and DLYCNT, as shown in FIG. 5. This pointer POUT points elements from which data is to be read out next of those of the ring buffers DLYKD and DLYCNT. The value of the pointer POUT is reset when it reaches "256".

(6) Delay mode register DLYMD . . . This register is set with "0" (common mode), "1" (minus mode), or "2" (plus mode) according to an operation of the switch S6, S7, or S8.

(7) Delay time register DLYTM . . . This register is set with a value (delay value) ranging from 0 to 250. This delay value defines a delay time of a sound source. This delay value is a value set in units of 2 msec, and a value obtained by doubling this delay value corresponds to a delay time in units of milliseconds. Upon operation of the switch S10 or S11, the delay value can be changed by one. When the switches S10 and S11 are depressed simultaneously, the delay value is reset to "0". The display DSP displays a value obtained by doubling the delay value stored in the register DLYTM (delay time in units of milliseconds).

(8) Run flag RUN . . . This flag is a 1-bit register. When this flag is set to be "1", it indicates that a write operation in the record mode or a performance operation in the play mode is in progress; when it is set to be "0", both of these operations are interrupted.

(9) Record/play flag REC . . . This flag is a 1-bit register. When this flag is set to be "1", it indicates the record mode; when it is set to be "0", it indicates the play mode.

(10) External input flag IN . . . This flag is a 1-bit register. When this flag is set to be "1", it indicates that an external input (an input from the outside) is enabled; when it is set to be "0", it indicates that an external input is disabled.

(11) External output flag OUT . . . This flag is a 1-bit register. When this flag is set to be "1", it indicates that an external output (an output to the outside) is enabled; when it is set to be "0", it indicates that an external output is disabled.

(12) Tone generation flag SND . . . This flag is a 1-bit register. When this flag is set to be "1", it represents that tone generation of the internal sound source is enabled; when it is set to be "0", it indicates that tone generation of the internal sound source is disabled.

(13) Key data register KD . . . This register is an 8-bit register for storing key data.

(14) Tempo clock counter CLK . . . This counter serves as a register for counting the tempo clock signal TCL generated by the tempo clock generator 20. This counter counts a count value ranging from 0 to 31 within one measure, and is reset to 0 when its count value reaches 32.

(15) Variable register i . . . This register can be set with an arbitrary variable. In this embodiment, an address value stored in the pointer POUT is set.

5. Key Data Delay Control Operation (FIG. 6)

Figure 6:
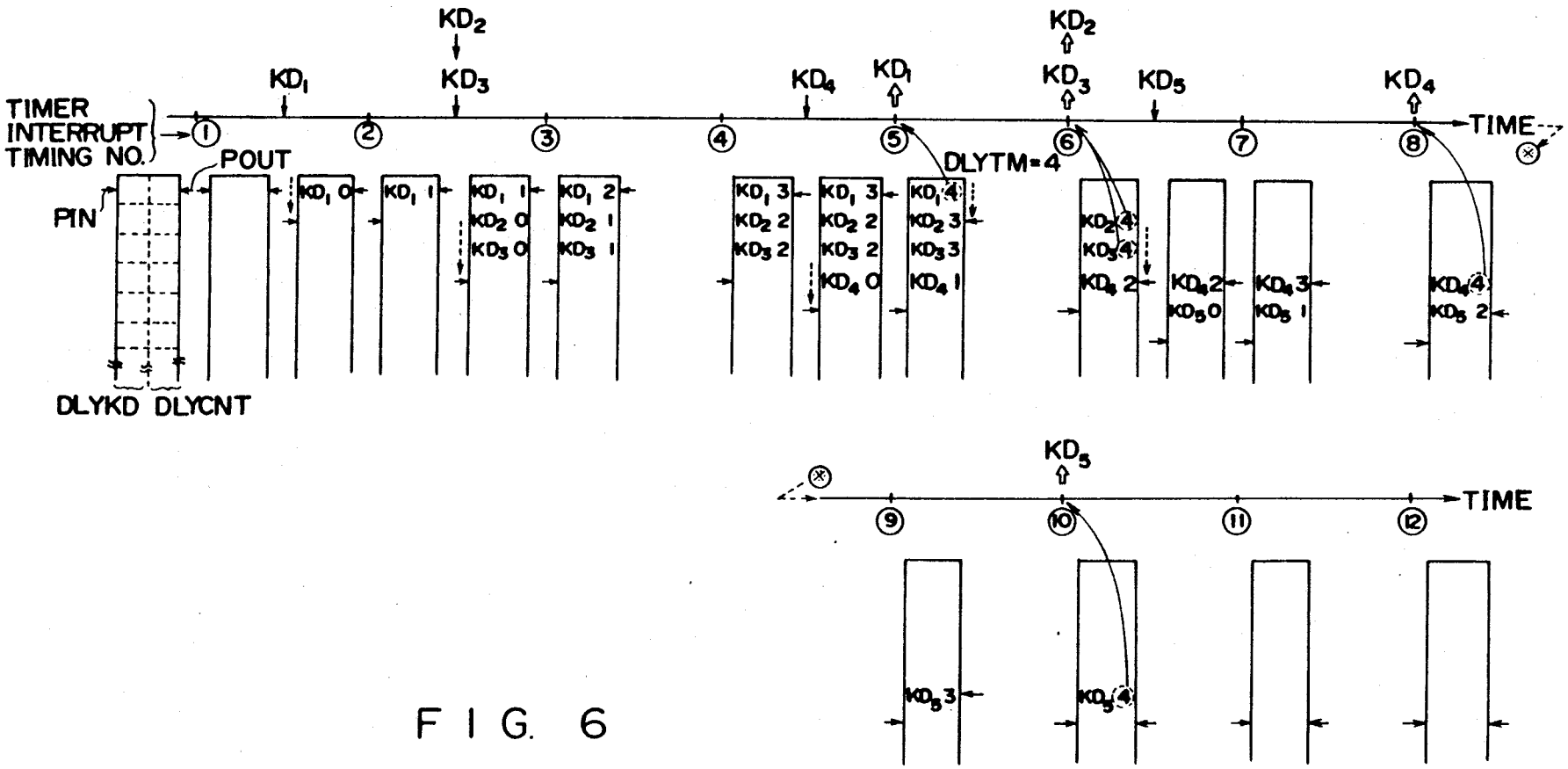
FIG. 6 is a timing chart for explaining delay control operations of key data.

FIG. 6 is a view for explaining a key data delay control operation, and shows a timer interrupt based on the timing signal TMC, and changes in contents of the ring buffers DLYKD and DLYCNT upon input of key data KD1 and KD2.

In an initial state, both the ring buffers DLYKD and DLYCNT are empty, and the values of both the pointers PIN and POUT are "0". More specifically, the pointers PIN and POUT point elements (starting elements) at an address "0" of the ring buffers DLYKD and DLYCNT.

In a first timer interrupt (timing No. (1)), the contents of both the ring buffers DLYKD and DLYCNT are left unchanged. Thereafter, when key data KD1 is inputted, the key data KD1 is set in an element DLYKD(PIN) pointed by the pointer PIN in the ring buffer DLYKD, and "0" is set in an element DLYCNT(PIN) pointed by the pointer PIN in the ring buffer DLYCNT. In this case, the key data KD1 and "0" are set in the starting elements DLYKD(0) and DLYCNT(0) in these ring buffers, respectively. The pointer PIN is then incremented.

In a second timer interrupt (timing No. (2)), in the ring buffer DLYCNT, a count value of each element (including a pointed element itself) between an element pointed by PIN-1 and an element pointed by POUT is incremented. In this case, an element DLYCNT(0) at an address "0" is incremented.

Assume that key data KD2 and KD3 are inputted thereafter. The key data KD2 is set in an element pointed by the pointer PIN in the ring buffer DLYKD, and "0" is set in an element pointed by the pointer PIN in the ring buffer DLYCNT. The value of the pointer PIN is then incremented. Similarly, the key data KD3 is set in an element pointed by the pointer PIN in the ring buffer DLYKD, and "0" is set in an element pointed by the pointer PIN in the ring buffer DLYCNT. Then, the value of the pointer PIN is incremented. In this case, DLYKD(1)=KD2, DLYCNT(1)=0, DLYKD(2)=KD3, and DLYCNT(2)=0 are set.

In a third timer interrupt (timing No. (3)), in the ring buffer DLYCNT, a count value of each element (including a pointed element itself) between an element pointed by PIN-1 and an element pointed by POUT is incremented. In this case, elements DLYCNT(0) to DLYCNT(2) at addresses "0" to "2" are incremented, respectively.

Thereafter, every time a timer interrupt occurs, a count value of each element (including a pointed element itself) between an element pointed by PIN-1 and an element pointed by POUT in the ring buffer DLYCNT is incremented. Every time key data is inputted, the inputted key data is set in an element DLYKD(PIN) in the ring buffer DLYKD pointed by the pointer PIN, and "0" is set in an element DLYCNT(PIN) in the ring buffer DLYCNT pointed by the pointer PIN. Then, the value of the pointer PIN is incremented.

Assume that "4" is set in the delay time register DLYTM beforehand. In a fifth timer interrupt (timing No. (5)), the count value of an element DLYCNT(POUT) pointed by the pointer POUT becomes "4". Since this count value coincides with the value of the delay time register DLYTM, a predetermined delay time has elapsed at the timing of the timing No. (5) after the key data KD1 is inputted. The key data KD1 is outputted to the sound source, and the value of the pointer POUT is incremented. In this case, an output destination of the key data KD1 varies depending on a selected one of the common, minus, plus, and piano modes as a delay mode. In the common mode, the key data KD1 is outputted to the internal and external sound sources; in the minus or piano mode, it is outputted to the internal sound source; and in the plus mode, it is outputted to the external sound source.

Operations in a sixth timer interrupt and thereafter are the same as those described above, and a detailed description thereof will be omitted.

6. Main Routine (FIG. 7)

Figure 7:
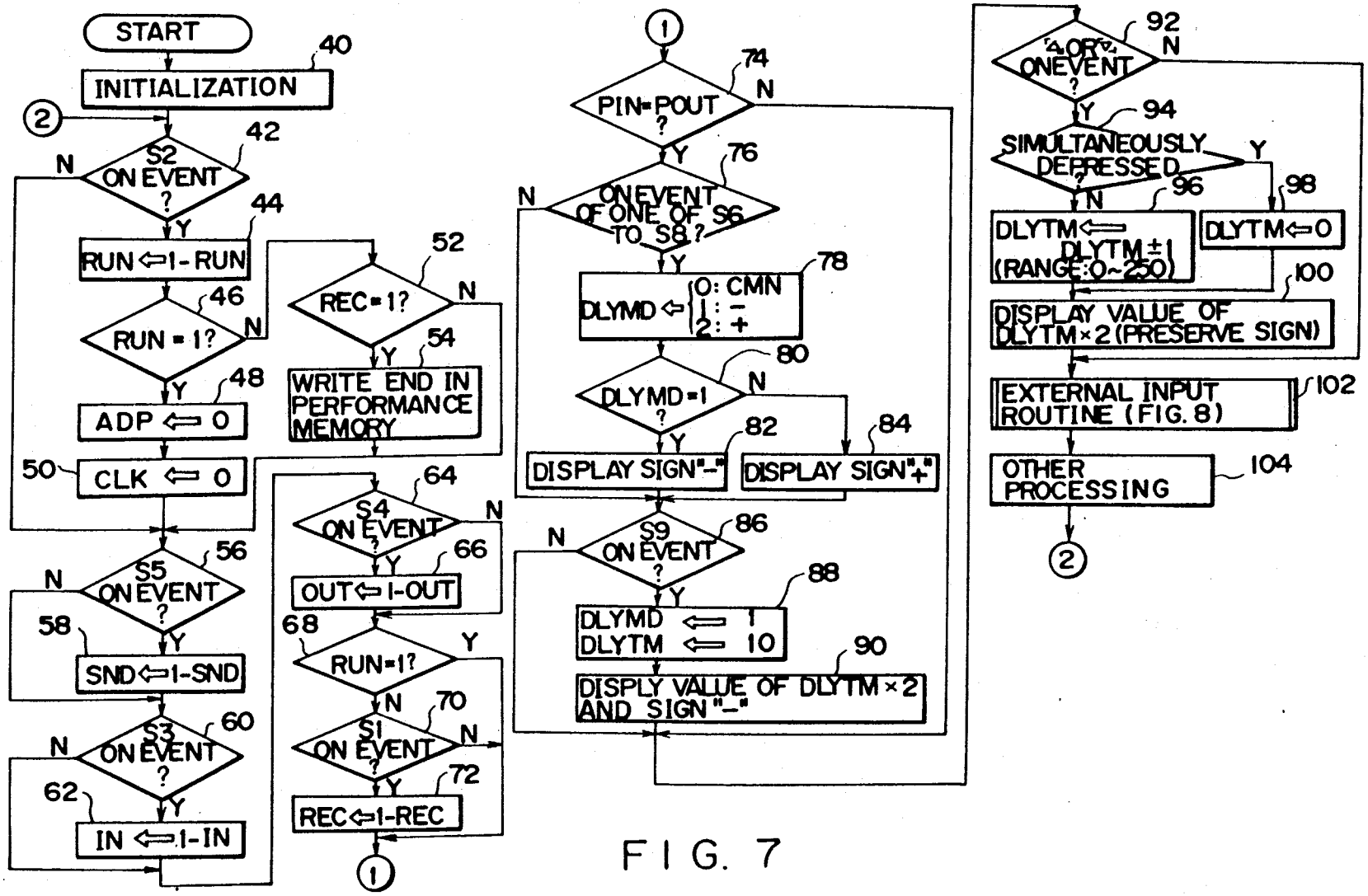
FIG. 7 is a flow chart showing a main routine.

FIG. 7 shows a flow of the processing in the main routine. This main routine is started upon power-on.

In step 40, initialization processing is performed. For example, "0"s are set in the registers RUN, CLK, PIN, POUT, REC, DLYMD, DLYTM, and the like. The processing advances to step 42.

It is checked in step 42 if an ON event of the switch S2 is detected. If Y (YES) in step 42, the processing advances to step 44, and a value obtained by subtracting the value of the run flag RUN from 1 is set in the run flag RUN. More specifically, if the value of the run flag RUN is "1", it is inverted to "0"; if it is "0", it is inverted to "1". The processing advances to step 46 to check if the value of the run flag RUN is "1" (start).

If Y in step 46, "0" is set in the address pointer ADP in step 48, and "0" is set in the tempo clock counter CLK in step 50. This is initialization processing performed when the operation in the record or play mode is started. If N (NO) in step 46, the processing advances to step 52 to check if the value of the record/play flag REC is "1" (record mode).

If Y in step 52, this means that an operator stops a write operation in the record mode. In step 54, end code data END is written in the performance memory 18. If N in step 52, this means that an operator stops an automatic performance operation in the play mode.

If N in step 42 or 52, or when processing in step 50 or 54 is completed, the processing advances to step 56 to check if an ON event of the switch S5 is detected. If Y in step 56, the value of the tone generation flag SND is inverted in step 58.

However, if N in step 56, or if processing in step 58 is completed, the processing advances to step 60 to check if an ON event of the switch S3 is detected. If Y in step 60, the value of the external input flag IN is inverted in step 62.

However, if N in step 60, or if processing in step 62 is completed, the processing advances to step 64 to check if an ON event of the switch S4 is detected. If Y in step 64, the value of the external output flag OUT is inverted in step 66.

However, if N in step 64 or if processing in step 66 is completed, the processing advances to step 68 to check if the value of the run flag RUN is "1". If N in step 68, it is checked in step 70 if an ON event of the switch S1 is detected. If Y in step 70, the value of the record/play flag REC is inverted in step 72. That is, only when the write operation in the record mode or the performance operation in the play mode is not being executed, the record mode can be switched to the play mode and vice versa.

If Y in step 68, or if N in step 70, or if processing in step 72 is completed, the processing advances to step 74.

It is checked in step 74 if the value of the pointer PIN is equal to the value of the pointer POUT (whether or not data to be delayed is stored in the ring buffer). If Y in step 74, the processing advances to step 76 to check if an ON event of one of the switches S6 to S8 is detected.

If Y in step 76, the processing advances to step 78, and a value corresponding to the depressed switch ("0"

for an ON event of the switch S6; "1" for an ON event of the switch S7; or "2" for an ON event of the switch S8) is set in the delay mode register DLYMD. The processing then advances to step 80 to check if the value of the delay mode register DLYMD is "1" (minus mode). If Y in step 80, a sign "−" is displayed on the display DSP in step 82; otherwise (N), a sign "+" is displayed on the display DSP in step 84.

If N in step 76 or if processing in step 82 or 84 is completed, the processing advances to step 86 to check if an ON event of the switch S9 is detected. If Y in step 86, this means that the piano mode is selected. Thus, in step 88, "1" is set in the delay mode register DLYMD, and "10" is set in the delay time register DLYTM. In step 90, a value obtained by doubling the value of the delay time register DLYTM (i.e., 20), and the sing "−" are displayed on the display DSP.

With the processing operations in steps 76 to 90, the delay mode can be changed only when there is no data to be delayed in the ring buffer.

If N in step 74 or 86, or if processing in step 90 is completed, the processing advances to step 92 to check an ON event of the switch S10 or S11 is detected. If Y in step 92, the processing advances to step 94 to check if the switches S10 and S11 are simultaneously depressed.

If N in step 94, the processing advances to step 96, and the value of the delay time register DLYTM is decremented (when the ON event of the switch S10 is detected), or incremented (when the ON event of the switch S11 is detected) according to the depressed switch. In this case, the value of the delay time register DLYTM can be changed within a range of 0 to 250. If Y in step 94, the processing advances to step 98, and "0" is set in the delay time register DLYTM.

If processing in step 96 or 98 is completed, the processing advances to step 100, and a value obtained by doubling the value of the delay time register DLYTM is displayed on the display DSP. In this case, the already displayed sign is preserved (kept displayed).

If N in step 92, or if processing in step 100 is completed, the processing advances to step 102, and an external input subroutine (FIG. 8) is executed.

Thereafter, other processing (e.g., setup processing of a tone color, tone volume, tempo, and the like) is executed in step 104, and the processing returns to step 42, thus repeating the subsequent processing operations as described above.

7. External Input Subroutine (FIG. 8)

Figure 8:
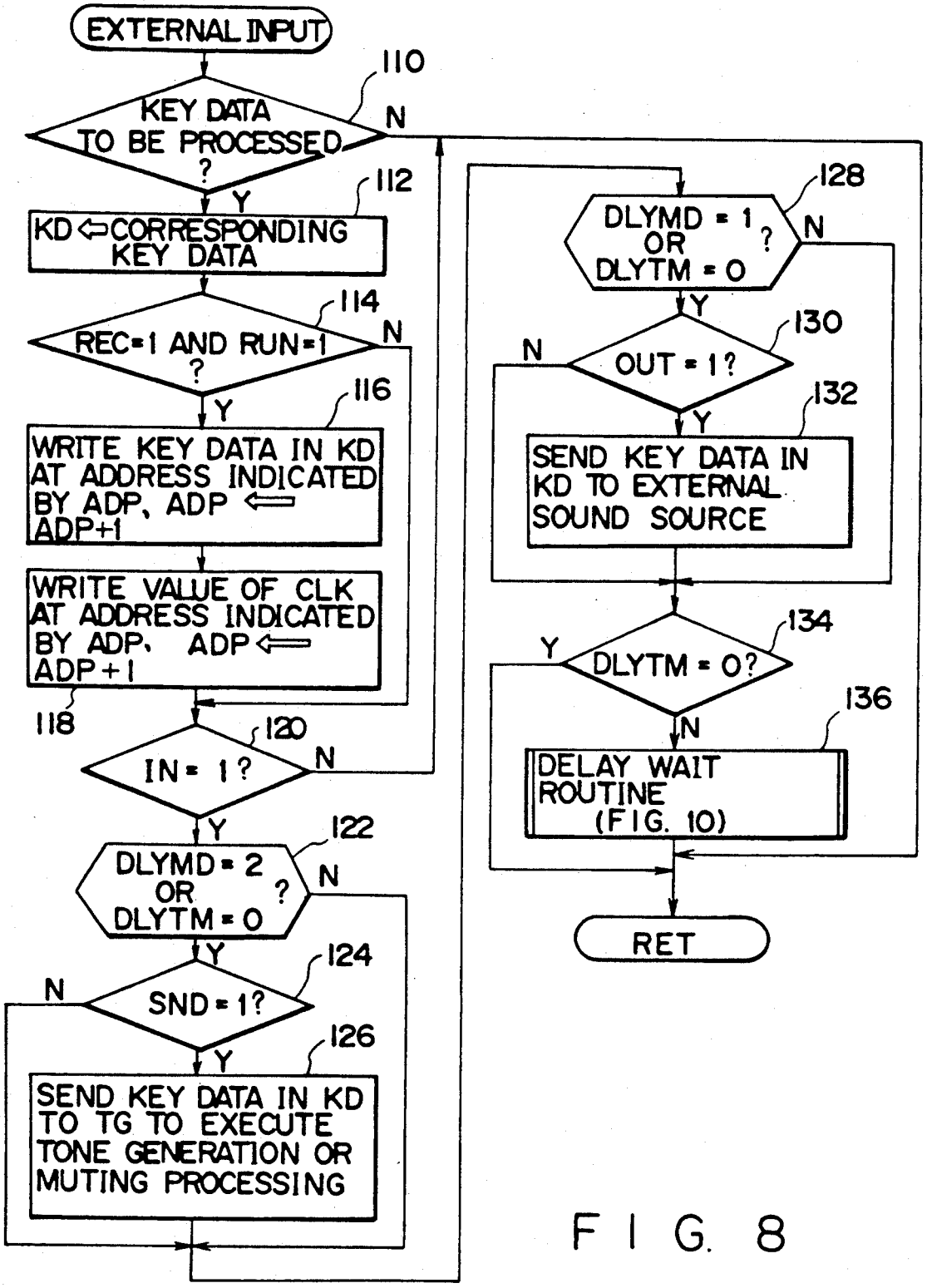
FIG. 8 is a flow chart showing an external input subroutine.

FIG. 8 shows an external input subroutine. In step 110, it is checked if there is externally inputted key data (key data from the outside) to be processed. If N in step 110, since processing to be described below is unnecessary, the processing returns to the routine shown in FIG. 7. Note that "RET" in FIGS. 8 to 11 indicates "return".

If Y in step 110, the key data to be processed is set in the register KD in step 112, and it is then checked in step 114 if the value of the record/play flag REC is "1" and the value of the run flag RUN is "1" (whether or not the write operation is being executed). If Y in step 114, the processing advances to step 116. In step 116, the key data in the register KD is written in a memory area in the performance memory 18 pointed by the address pointer ADP, and the value of the address pointer ADP is incremented. In step 118, the value of the tempo clock counter CLK is written in a memory area pointed by the address pointer ADP, and the value of the address pointer ADP is incremented. With the processing operations in steps 116 and 118, performance data is written in the performance memory 18.

If N in step 114 (i.e., if no write operation is being executed), or if processing in step 118 is completed, the processing advances to step 120 to check if the value of the external input flag IN is "1" (input enable mode). If N in step 120, since sound source control based on inputted key data is unnecessary, the processing returns to the routine shown in FIG. 7. If Y in step 120, the processing advances to step 122 to check if the value of the delay mode register DLYMD is "2" (plus mode) or the value of the delay time register DLYTM is "0" (no delay).

If Y in step 122, the processing advances to step 124 to check if the value of the tone generation flag SND is "1" (whether or not tone generation of the internal sound source is enabled). If Y in step 124, the processing advances to step 126, and the key data in the register KD is sent to the tone generator (internal sound source) 26 to execute tone generation or muting processing. More specifically, if the MSB (most significant bit) of the key data is "1", generation of a musical tone having a pitch corresponding to the key code in the key data is started; if the MSB of the key data is "0", a decay operation of the musical tone having the pitch corresponding to the key code in the key data is started.

If N in step 122 or 124, or if processing in step 126 is completed, the processing advances to step 128 to check if the value of the delay mode register DLYMD is "1" (minus mode) or the value of the delay time register DLYTM is "0" (no delay). If Y in step 128, the processing advances to step 130 to check if the value of the external output flag OUT is "1" (output enable mode). If Y in step 130, the processing advances to step 132, and the key data in the register KD is sent to the external sound source 32.

If N in step 128 or 130 or if processing in step 132 is completed, the processing advances to step 134 to check if the value of the delay time register DLYTM is "0" (no delay). If Y in step 134, since no delay control is necessary, the processing returns to the routine shown in FIG. 7. If N in step 134, however, the processing advances to step 136, and a delay wait subroutine is executed, as will be described later with reference to FIG. 10. After step 136, the processing returns to the routine shown in FIG. 7.

According to steps 122 to 132 described above, the internal and external sound sources can be immediately driven on the basis of the externally inputted key data.

8. Clock Interrupt Routine (FIG. 9)

Figure 9:
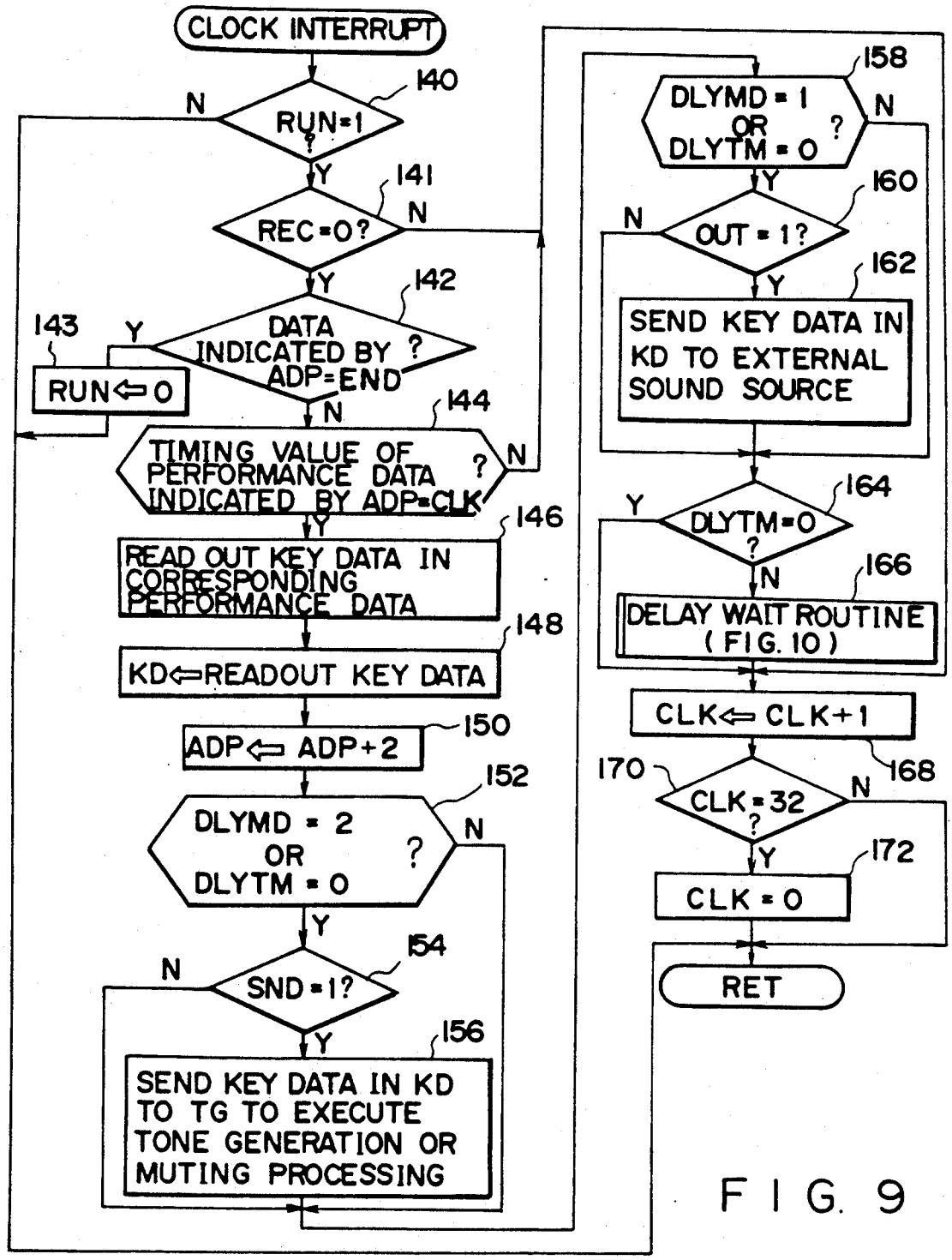
FIG. 9 is a flow chart showing a clock interrupt routine.

FIG. 9 shows a clock interrupt routine. This routine is started for each clock pulse of the tempo clock TCL.

In step 140, it is checked if the value of the run flag RUN is "1". If N in step 140, since processing to be described below is unnecessary, the processing returns to the routine shown in FIG. 7. If Y in step 140, the processing advances to step 141 to check if the value of the record/play flag REC is "0" (play mode). When N is obtained in step 141, since the record mode is set, the processing advances to step 168.

In step 168, the value of the tempo clock counter CLK is incremented. It is checked in step 170 if the value of the tempo clock counter CLK is "32". If N in step 170, the processing returns to the routine shown in FIG. 7. If Y in step 170, the tempo clock counter CLK is reset to "0" in step 172, and the processing then returns to the routine shown in FIG. 7.

In the record mode, the value of the tempo clock counter CLK is written in the performance memory 18 as timing data in step 118 in FIG. 8 described above.

If Y in step 141, since the play mode is selected, the processing advances to step 142. It is checked in step 142 if data in the performance memory 18 pointed by the address pointer ADP is the end code data END. If Y in step 142, "0" is set in the run flag RUN in step 143, and the processing then returns to the routine shown in FIG. 7. As a result, the automatic performance operation is ended. Thereafter, even if the processing enters this routine (FIG. 9), since N is determined in step 140, processing in step 141 and subsequent steps is not executed.

If N in step 142, the processing advances to step 144 to check if a timing value of performance data pointed by the address pointer ADP is equal to the value of the tempo clock counter CLK. If N in step 144, since a readout timing is not reached, the processing advances to step 168 to similarly execute the subsequent processing, as described above, and the processing then returns to the routine shown in FIG. 7.

If Y in step 144, the processing advances to step 146, and key data in performance data pointed by the address pointer ADP is read out. The readout key data is set in the register KD in step 148, and the value of the address pointer ADP is incremented by 2 in step 150. As a result, the address pointer ADP points the next performance data to be read out.

After step 150, the processing advances to step 152. Processing operations in steps 152, 154, 156, 158, 160, 162, 164, and 166 are the same as those in steps 122, 124, 126, 128, 130, 132, 134, and 136 in FIG. 8 described above, and a detailed description thereof will be omitted. According to the processing in steps 152 to 162, the internal and external sound sources can be immediately driven on the basis of key data read out from the performance memory 18. According to the processing in steps 164 and 166, the delay wait subroutine shown in FIG. 10 is executed only when the value of the delay time register DLYTM is not "0".

After step 166, the processing in step 168 and subsequent steps is executed as described above, and the processing then returns to the routine shown in FIG. 7.

9. Delay Wait Subroutine (FIG. 10)

Figure 10:
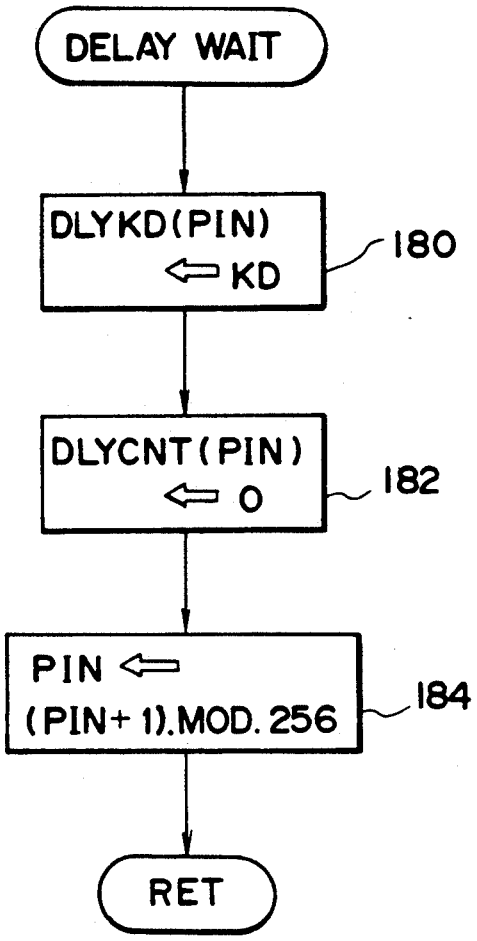
FIG. 10 is a flow chart showing a delay wait subroutine.

FIG. 10 shows the delay wait subroutine. In step 180, key data in the register KD is set in an element DLYKD(PIN) pointed by the pointed PIN in the ring buffer DLYKD. The processing advances to step 182, and "0" is set in an element DLYCNT(PIN) pointed by the pointer PIN in the ring buffer DLYCNT.

Thereafter, in step 184, a value obtained by the following calculation is set in the pointer PIN:

$$(PIN+1)\cdot MOD\cdot 256$$

In general, a calculation of A·MOD·B is to divide A with B (integer calculation) to obtain a remainder. Therefore, according to the calculation of (PIN+1)·MOD·256, if the value of the pointer PIN is one of 0 to 254, the value of PIN+1 is set in the pointer PIN (i.e., the value of the pointer PIN is incremented); when the value of the pointer PIN is 255, "0" is set in the Processing operations in steps 180 to 184 correspond to operations performed when key data KD1 or the like is inputted, as has been described above with reference to FIG. 6. After step 184, the processing returns to the main routine (the routine shown in FIG. 8 to 9).

10. Timer Interrupt Routine (FIG. 11)

Figure 11:
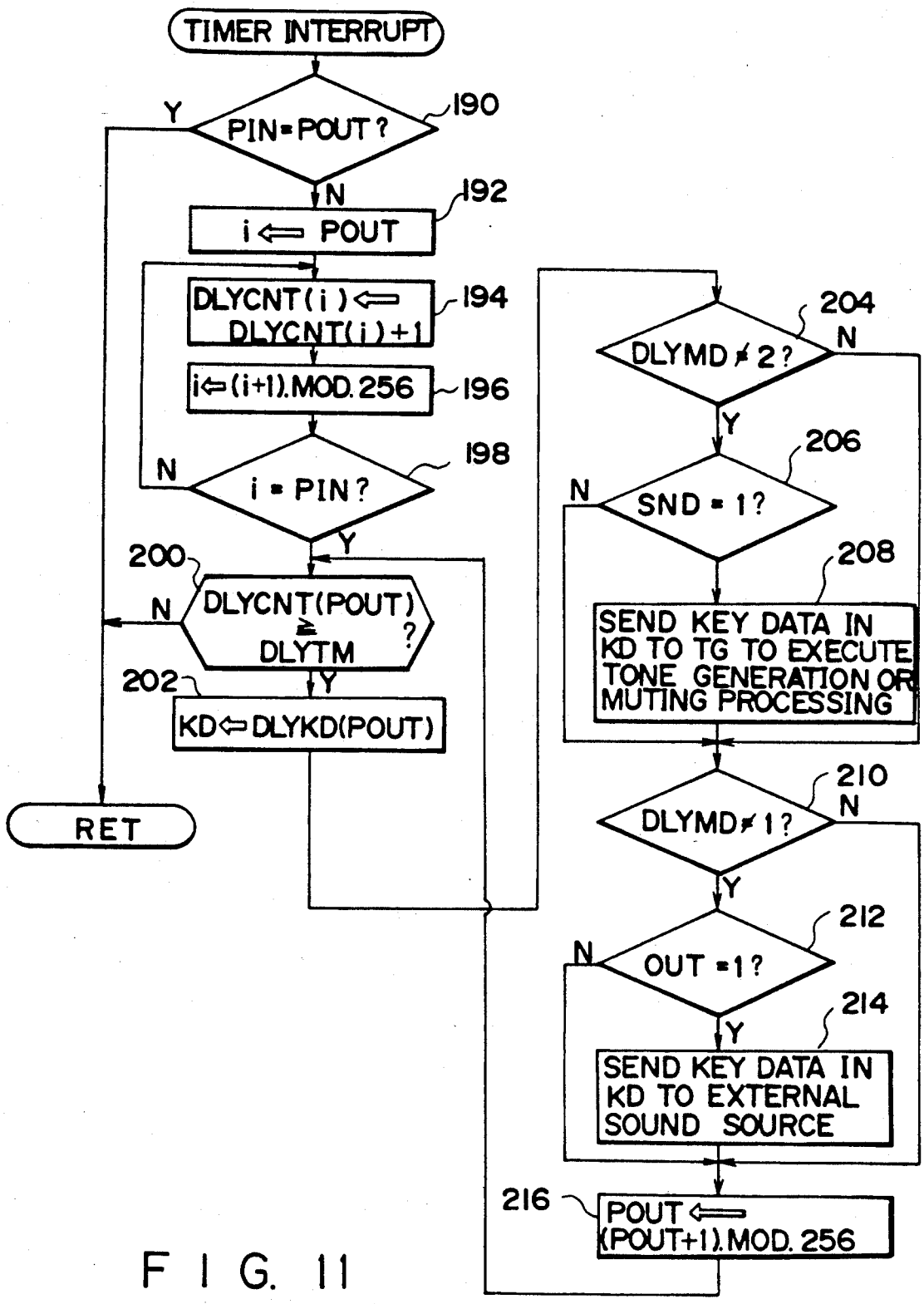
FIG. 11 is a flow chart showing a timer interrupt routine.

FIG. 11 shows a timer interrupt routine. This routine is started every time the timing signal TMC is generated (i.e., with 2-msec cycles).

In step 190, it is checked if the value of the pointer PIN is equal to the value of the pointer POUT. If Y in step 190, since there is no data to be delayed and outputted in the ring buffer, the processing returns to the routine shown in FIG. 7.

If N in step 190, the processing advances to step 192, and the value of the pointer POUT is set in the register i. The processing advances to step 194.

In step 194, a count value of an element DLYCNT(i) pointed by the register i in the ring buffer DLYCNT is incremented. The processing advances to step 196, and a value obtained by a calculation of (i+1)·MOD·256 is set in the register i. More specifically, when the value of the register i is one of 0 to 254, a value of i+1 is set in the register i (i.e., the value of the register i is incremented); when the value of the register i is 255, "0" is set in the register i.

It is then checked in step 198 if the value of the register i is equal to the value of the pointer PIN. If N in step 198, the processing returns to step 194, and steps 194 to 198 are repeated until i=PIN is established. As a result, as has been described above with reference to FIG. 6, count values at addresses between PIN-1 and POUT are incremented (for example, see changes in count values of elements DLYCNT(0) to DLYCNT(2) in the ring buffer at the timer interrupt timing No. ③ in FIG. 6).

If i=PIN, Y is determined in step 198, and the processing advances to step 200. It is checked in step 200 if a count value of an element DLYCNT(POUT) pointed by the pointer POUT in the ring buffer DLYCNT is equal to or larger than the value of the delay time register DLYTM. If N in step 200, since an output delay time has not reached yet, the processing returns to the routine shown in FIG. 7. For example, this corresponds to a state in which no key data is outputted at timings of timer interrupt timing Nos. ② to ④ in FIG. 6.

If Y in step 200, the processing advances to step 202, and key data in an element DLYKD(POUT) pointed by the pointer POUT in the ring buffer DLYKD is set in the register KD. The processing then advances to step 204.

It is checked in step 204 if the value of the delay mode register DLYMD is other than "2" (common or minus mode). If Y in step 204, the processing advances to step 206. It is checked in step 206 if the value of the tone generation flag is "1" (whether or not tone generation of the internal sound source is enabled). If Y in step 206, the processing advances to step 208. In step 208, key data in the register KD is sent to the tone generator 26 as the internal sound source like in step 126 in FIG. 8 described above to execute tone generation or muting processing.

If N in step 204 or 206, or if processing in step 208 is completed, the processing advances to step 210 to check if the value of the delay mode register DLYMD is other than "1" (common or plus mode). If Y in step 210, the processing advances to step 212 to check if the value of the external output flag OUT is "1" (whether or not an external output is enabled). If Y in step 212, the processing advances to step 214, and key data in the register KD is sent to the external sound source 32 like in step 132 in FIG. 8 described above.

If N in step 210 or 212 or if processing in step 214 is completed, the processing advances to step 216, and a value obtained by a calculation of (POUT+1)-MOD·256 is set in the pointer POUT. More specifically, when the value of the pointer POUT is one of 0 to 254, a value of POUT+1 is set in the pointer POUT (i.e., the value of the pointer POUT is incremented); when the value of the pointer POUT is 255, "0" is set in the pointer POUT.

After step 216, the processing returns to step 200, and the subsequent processing operations are repeated as described above. As a result, for example, if there are a plurality of key data KD2 and KD3 which have been delayed by a delay time equal to the value of the delay time register DLYTM at a timing of the timer interrupt timing No. (6) in FIG. 6, the plurality of key data are almost simultaneously outputted.

In step 200, since not only DLYCNT(POUT)=DLYTM but also DLYCNT(POUT)>DLYTM are checked, when, for example, "3" is set as the value of the delay time register DLYTM immediately before the timing of the timer interrupt timing No. (5) in FIG. 6, not only key data KD2 and KD3 but also key data KD1 are outputted in a timer interrupt corresponding to the timing No. (5).

11. Variations of Embodiment

The present invention is not limited to the above embodiment, and various modifications and changes may be made. For example, the following modifications are available.

(1) All the delay times may be present (fixed) values.

(2) A plurality of sound sources may be arranged as an internal or external sound source, and a delay time may be set in units of sound sources.

(3) An object of delay control is not limited to key data, but may include operation element data such as a tone color or a tone volume. Alternatively, an object of delay control may be limited to key data without operation element data.

(4) A sound source for starting tone generation with a delay time from a tone generation instruction is not limited to a mechanical sound source but may be an electronic sound source which requires much time for a large calculation volume.

Figure 12:
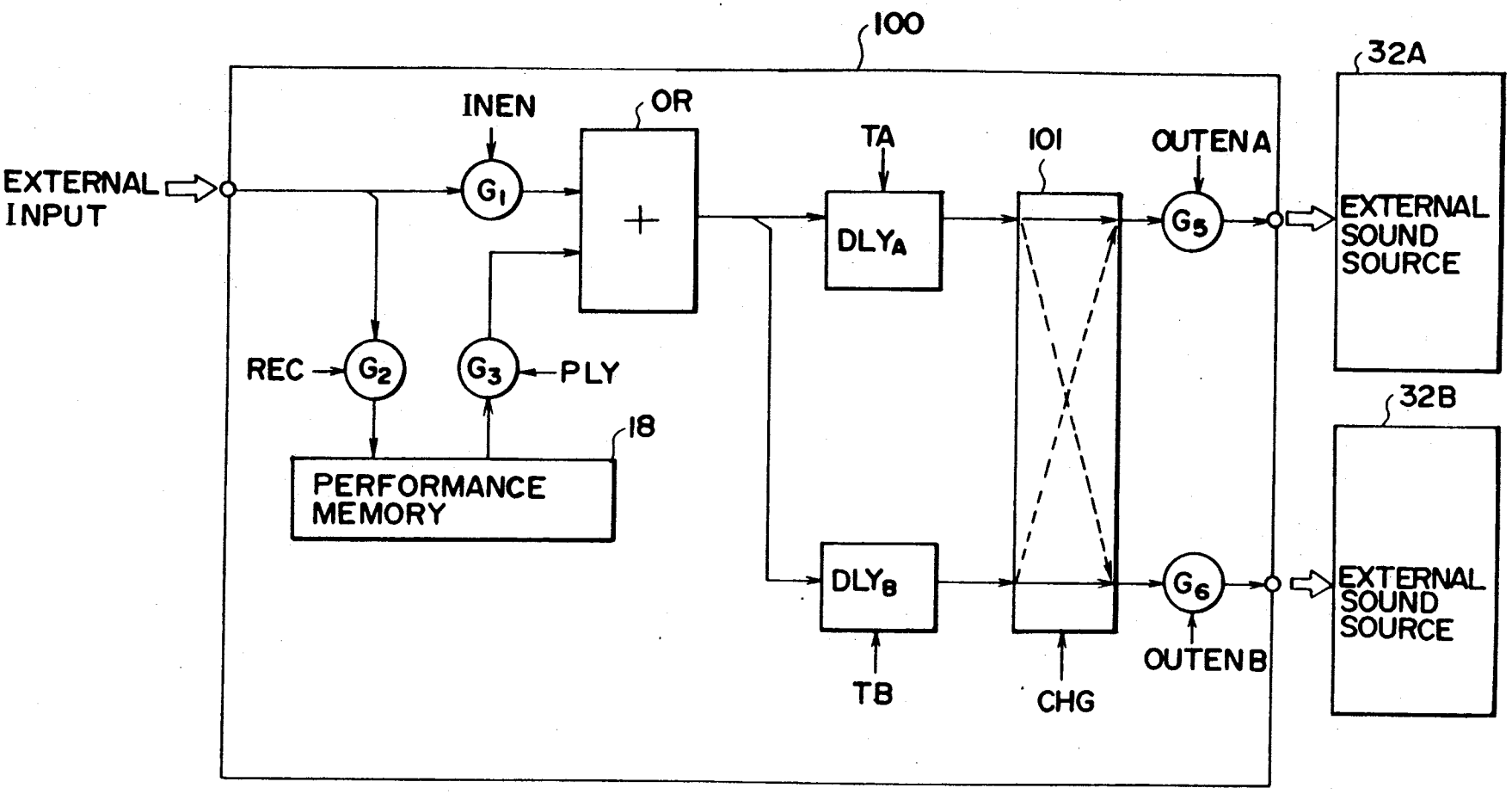
FIG. 12 is a diagram showing an automatic performance apparatus according to another embodiment of the present invention.

(5) The connections between sound sources and delay means may be switched depending on a selected mode. FIG. 12 is a diagram showing an automatic performance apparatus 100 according to such an embodiment. The same reference numerals as in FIG. 12 denote the common parts to FIG. 2. The apparatus 100 shown in FIG. 12 comprises a key data output means 101, and can switch connections like in item (I) or (II) to be described below:

(I) An output of a first delay means $DLY_A$ is connected to a first sound source 32A, and an output of a second delay means $DLY_B$ is connected to a second sound source 32B. These connections are indicated by solid lines in the key data output means 101 in FIG. 12.

(II) An output of the first delay means $DLY_A$ is connected to the second sound source 32B, and an output of the second delay means $DLY_B$ is connected to the first sound source 32A. These connections are indicated by broken lines in the key data output means 101 in FIG. 12.

Reference symbols TA and TB denote setup values of delay times in the first and second delay means $DLY_A$ and $DLY_B$. When output enable modes of the respective sound sources ($OUTEN_A$ and $OUTEN_B$) are set by external switches, key data outputted from the key data output means 101 are supplied to the external sound sources 32A and 32B via gates G5 and G6. According to this key data, the external sound sources 32A and 32B generate musical tone signals.

In order to realize the automatic performance apparatus 100, as shown in FIG. 12, a mode switch and a flag CHG are added to the automatic performance apparatus 10 shown in FIG. 1, and the flag CHG is switched by this switch. In steps 126 and 132 in FIG. 8, steps 156 and 162 in FIG. 9, and steps 208 and 214 in FIG. 11, a sound source to which key data is to be sent can be determined on the basis of the flag CHG.

As described above, according to the present invention, since key data is delay-controlled to synchronize musical tone generation among a plurality of sound sources, a preferable musical session effect can be obtained.

The present invention has been described above with reference to its preferred embodiments. However, the present invention is not limited to these embodiments. For example, it is obvious to those who are skilled in the art that various other changes, improvements, and combinations may be made.

What is claimed is:

1. An automatic performance apparatus for outputting key data to different kinds of first and second internal or external sound sources and causing said first and second sound sources to synchronously generate tones, comprising:

key data generation means for sequentially generating key data;

first delay means for inputting the key data supplied from said key data generation means and outputting the key data to said first sound source after lapse of a first delay time; and second delay means for inputting the key data supplied from said key data generation means and outputting the key data to said second sound source after lapse of a second delay time;

the first and second delay means including setting means for respectively setting the first and second delay times.

2. An apparatus according to claim 1, wherein said key data generation means includes storage means for storing the key data, and readout means for reading out the key data from said storage means.

3. An apparatus according to claim 2, wherein said key data generation means includes data input means for inputting the key data.

4. An apparatus according to claim 3, wherein said key data generation means has alternative record and play modes, when the record mode is selected, the key data inputted from said data input means is stored in said storage means, and when the play mode is selected, the key data read out from said storage means is supplied to said first and second delay means.

5. An apparatus according to claim 3, further comprising means for selecting whether or not the key data inputted from said data input means is supplied to said first and second delay means.

6. An apparatus according to claim 3, wherein said first and second delay means receive both the key data inputted from said data input means and the key data read out from said storage means.

7. An apparatus according to claim 1, further comprising means for displaying the values of said first and second delay times.

8. An apparatus according to claim 1, wherein said first sound source is arranged inside said apparatus.

9. An apparatus according to claim 1, further comprising means for selecting whether or not the key data outputted from said first delay means is inputted to said first sound source.

10. An apparatus according to claim 1, further comprising means for selecting whether or not the key data outputted from said second delay means is inputted to said second sound source.

11. An automatic performance apparatus for outputting key data to different kinds of first and second internal or external sound sources and causing said first and second sound sources to synchronously generate tones, comprising:

key data generation means for sequentially generating key data;

first delay means for inputting the key data supplied from said key data generation means and outputting the key data as first key data after lapse of a first delay time;

second delay means for inputting the key data supplied from said key data generation means and outputting the key data as second key data after lapse of a second delay time;

mode designation means for alternatively designating a first or second mode; and key data output means for, when the first mode is designated by said mode designation means, inputting said first and second key data supplied from said first and second delay means and outputting said first and second key data to said first and second sound sources, respectively, and for, when the second mode is designated by said mode designation means, inputting said first and second key data supplied from said first and second delay means and outputting said first and second key data to said second and first sound sources, respectively.

12. An apparatus according to claim 11, wherein said key data generation means includes storage means for storing the key data, and readout means for reading out the key data from said storage means.

13. An apparatus according to claim 12, wherein said key data generation means includes data input means for inputting the key data.

14. An apparatus according to claim 13, wherein said key data generation means had alternative record and play modes, when the record mode is selected, the key data inputted from said data input means is stored in said storage means, and when the play mode is selected, the key data read out from said storage means is supplied to said first and second delay means.

15. An apparatus according to claim 13, further comprising means for selecting whether or not the key data inputted from said data input means is supplied to said first and second delay means.

16. An apparatus according to claim 13, wherein said first and second delay means receive both the key data inputted from said data input means and the key data read out from said storage means.

17. An apparatus according to claim 11, wherein said first and second delay means include setting means for respectively setting the first and second delay times.

18. An apparatus according to claim 11, further comprising means for selecting whether or not the key data outputted from said first delay means is inputted to said first or second sound source.

19. An apparatus according to claim 11, further comprising means for selecting whether or not the key data outputted from said second delay means is inputted to said first or second sound source.

* * * * *